US010501299B2

(12) United States Patent
Valentine

(10) Patent No.: US 10,501,299 B2
(45) Date of Patent: Dec. 10, 2019

(54) CONTAINER LID ROTATING DEVICE

(71) Applicant: Kay Valentine, Maplewood, NJ (US)

(72) Inventor: Kay Valentine, Maplewood, NJ (US)

( * ) Notice: Subject to any disclaimer, the term of this patent is extended or adjusted under 35 U.S.C. 154(b) by 186 days.

(21) Appl. No.: 15/834,896

(22) Filed: Dec. 7, 2017

(65) Prior Publication Data

US 2019/0177146 A1 Jun. 13, 2019

(51) Int. Cl.

| | |
|---|---|
| ***B67B 7/14*** | (2006.01) |
| ***B67B 7/18*** | (2006.01) |
| ***B67B 7/16*** | (2006.01) |

(52) U.S. Cl.

CPC ..... *B67B 7/14* (2013.01); *B67B 7/18* (2013.01); *B67B 7/16* (2013.01)

(58) Field of Classification Search

CPC ..... B67B 7/14; B67B 7/16; B67B 7/18; Y10S 16/12

USPC ..... 81/3.4; D8/33, 38, 40, 43

See application file for complete search history.

(56) References Cited

U.S. PATENT DOCUMENTS

| | | | | |
|---|---|---|---|---|
| 440,843 | A | 11/1890 | Haines | |
| 1,952,660 | A | 3/1934 | Dryden | |
| 2,235,313 | A | 3/1941 | Cleveland | |
| 4,001,904 | A * | 1/1977 | Gill | B67B 7/18 7/151 |
| 4,760,763 | A | 8/1988 | Trick et al. | |
| D365,261 | S * | 12/1995 | Munro | D8/40 |
| 5,517,881 | A | 5/1996 | Burns | |
| 5,770,297 | A | 6/1998 | Grubich | |
| 6,415,688 | B1 | 7/2002 | Smith | |
| 6,640,665 | B1 | 11/2003 | Williamson | |

* cited by examiner

*Primary Examiner* — David B. Thomas

(57) ABSTRACT

A container lid rotating device for removing and attaching container lids includes a plurality of shells. The shells are resilient. Each shell has a bottom that is open and a top that is domed so that the shell is bowl-shaped. Each shell has a respective size so that the plurality of shells comprises a variety of sizes and is configured to be nested. Each shell is configured to insert a lid of a respective container through the bottom into the shell. The shell is positioned to be grasped in a hand of a user to rotate the shell and the lid relative to the respective container to selectively open and close the container.

18 Claims, 7 Drawing Sheets

CONTAINER LID ROTATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

Field of the Invention

Description of Related Art Including Information Disclosed Under 37 CFR 1.97 and 1.98

The disclosure and prior art relates to rotating devices and more particularly pertains to a new rotating device for removing and attaching container lids.

BRIEF SUMMARY OF THE INVENTION

An embodiment of the disclosure meets the needs presented above by generally comprising a plurality of shells. The shells are resilient. Each shell has a bottom that is open and a top that is domed so that the shell is bowl-shaped. Each shell has a respective size so that the plurality of shells comprises a variety of sizes and is configured to be nested. Each shell is configured to insert a lid of a respective container through the bottom into the shell. The shell is positioned to be grasped in a hand of a user to rotate the shell and the lid relative to the respective container to selectively open and close the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
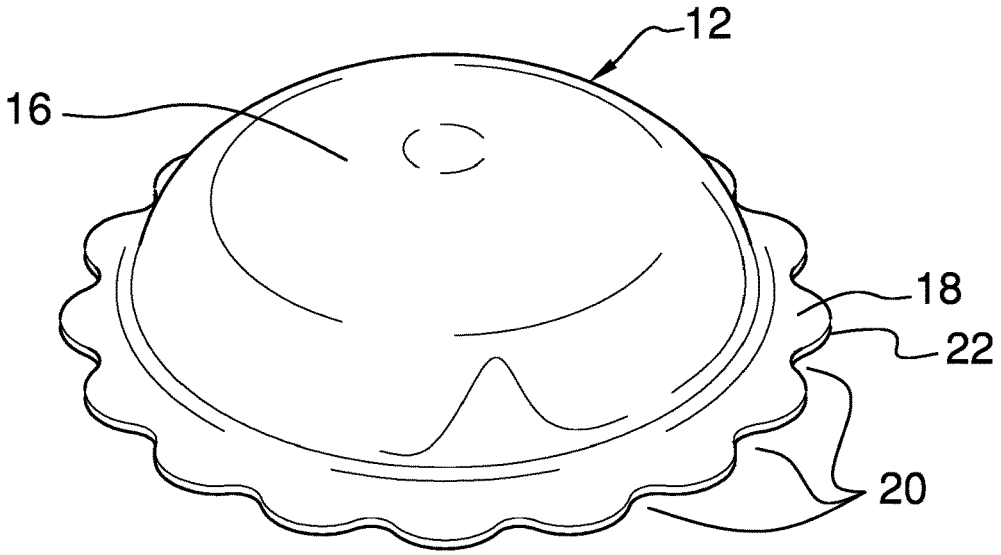
FIG. 1 is an isometric perspective view of a container lid rotating device according to an embodiment of the disclosure.
Figure 2:
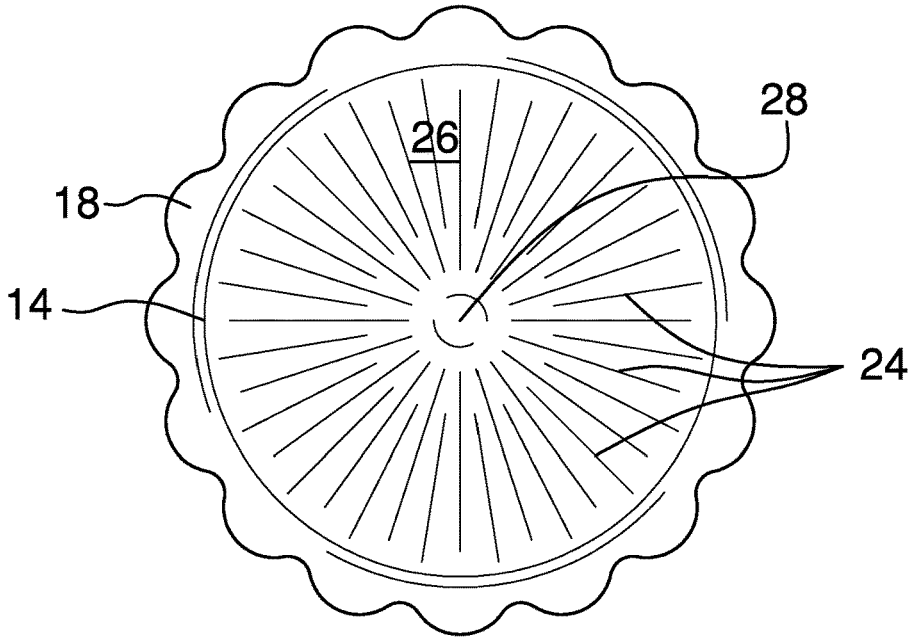
FIG. 2 is a bottom view of an embodiment of the disclosure.
Figure 3:
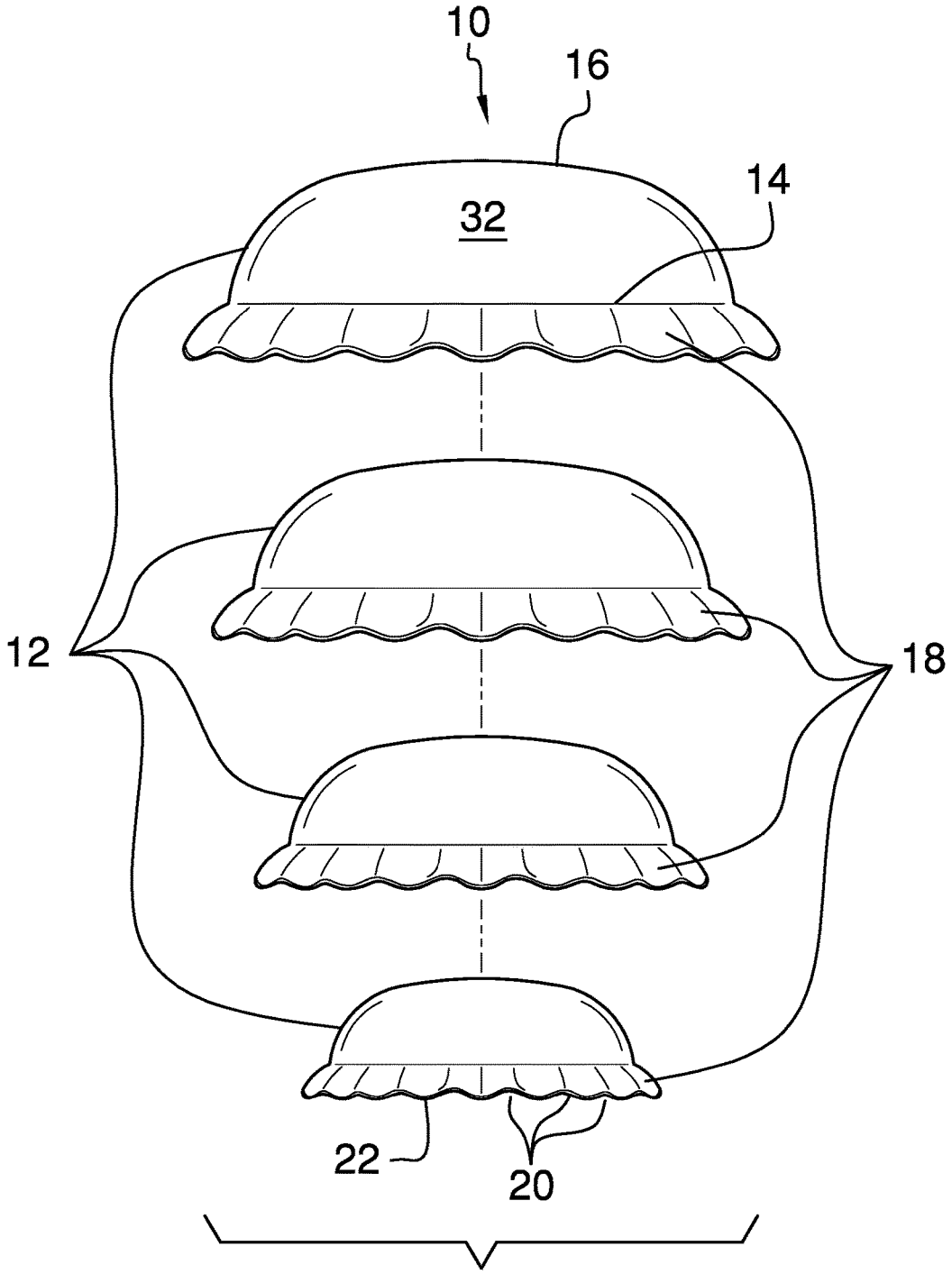
FIG. 3 is an exploded view of an embodiment of the disclosure.
Figure 4:
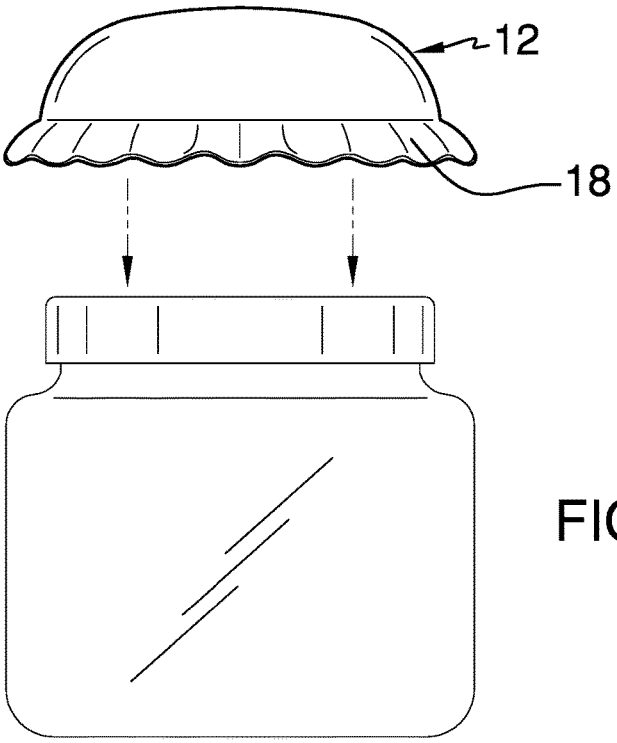
FIG. 4 is a detail view of an embodiment of the disclosure.
Figure 5:
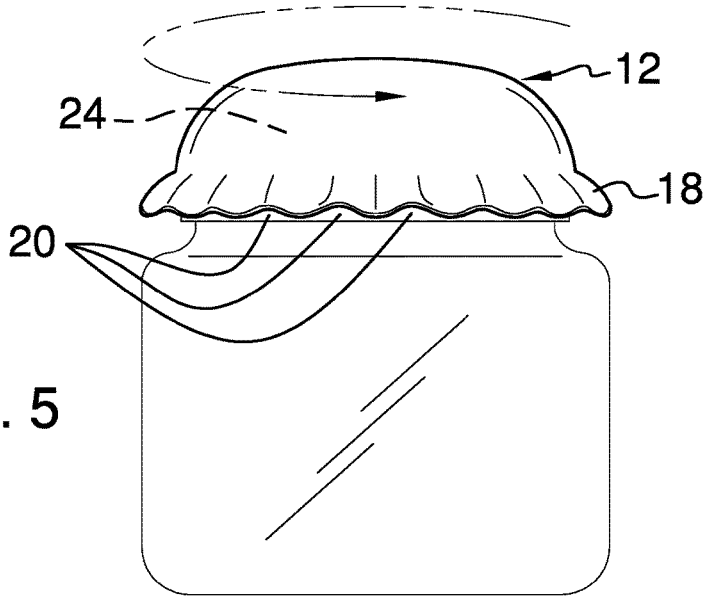
FIG. 5 is an in-use view of an embodiment of the disclosure.
Figure 6:
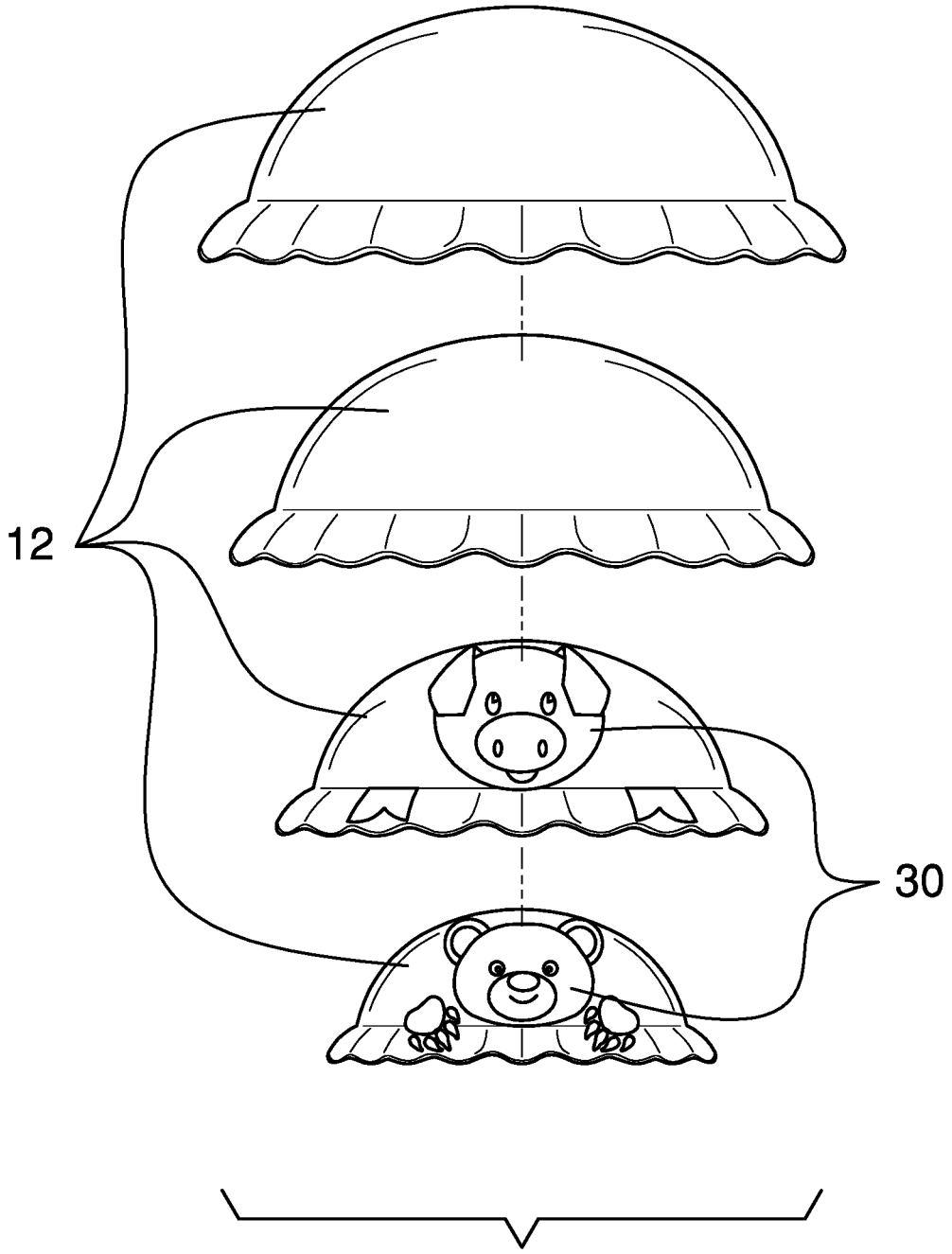
FIG. 6 is an exploded view of an embodiment of the disclosure.
Figure 7:
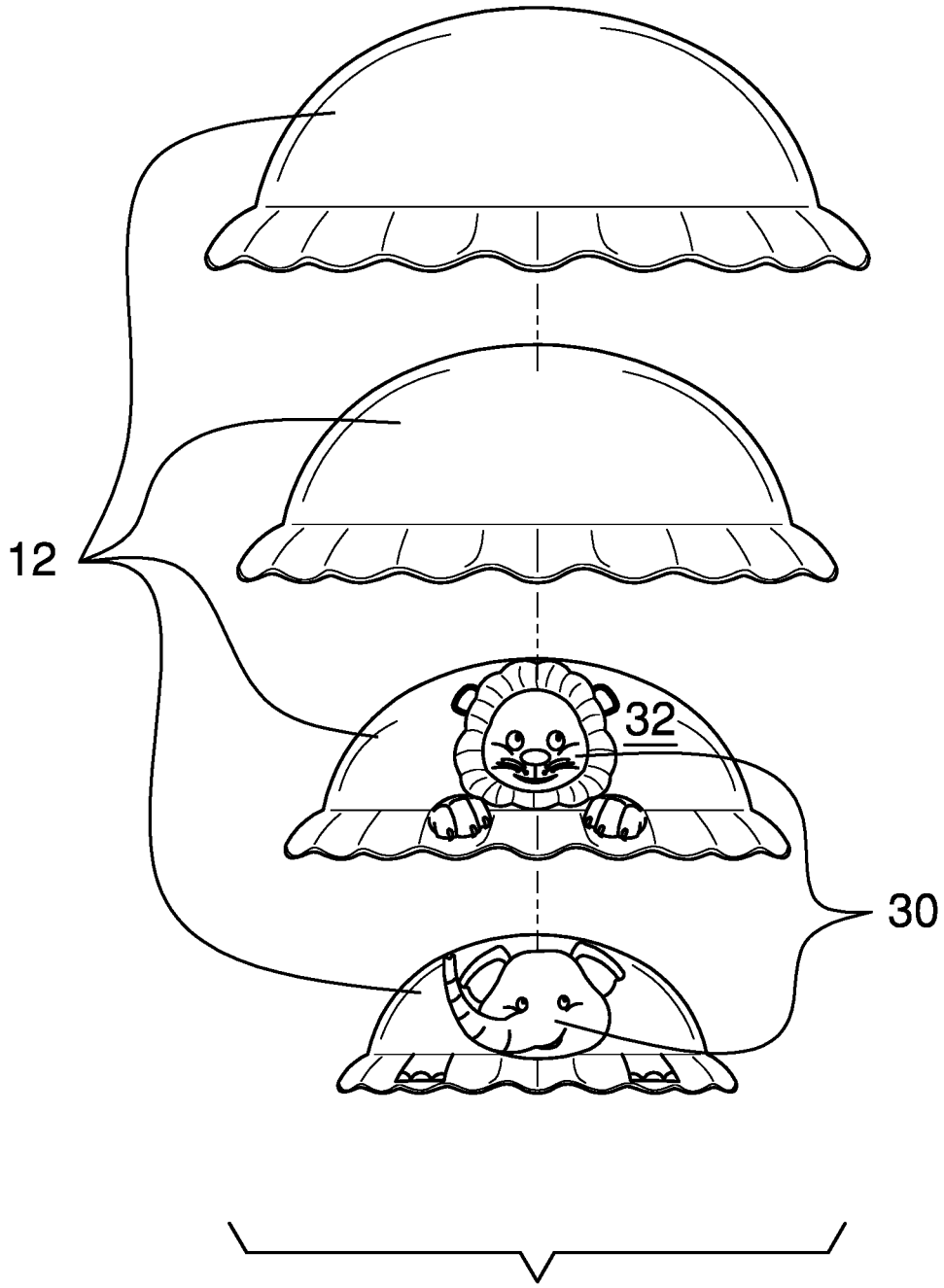
FIG. 7 is an exploded view of an embodiment of the disclosure.
Figure 8:
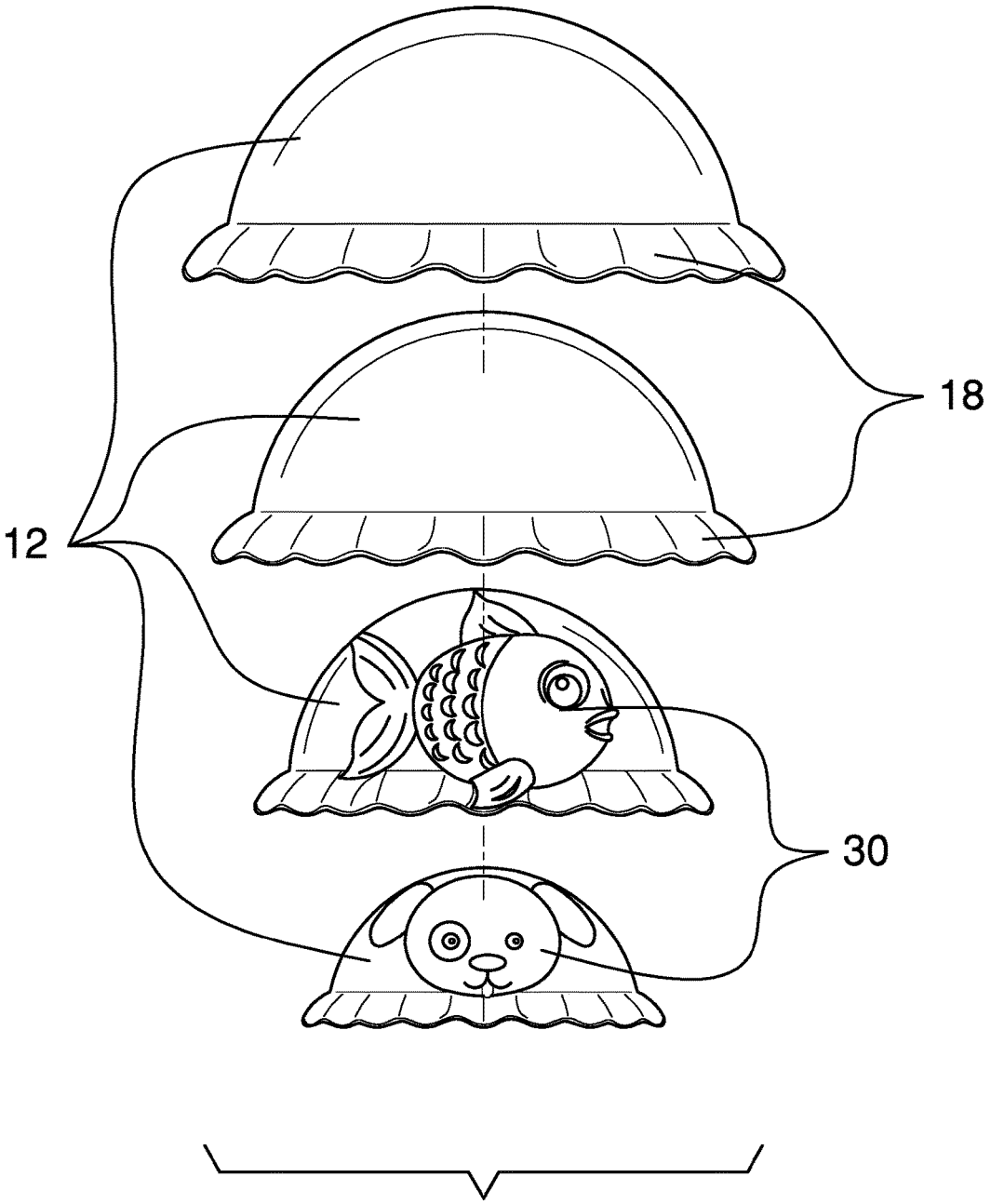
FIG. 8 is an exploded view of an embodiment of the disclosure.
Figure 9:
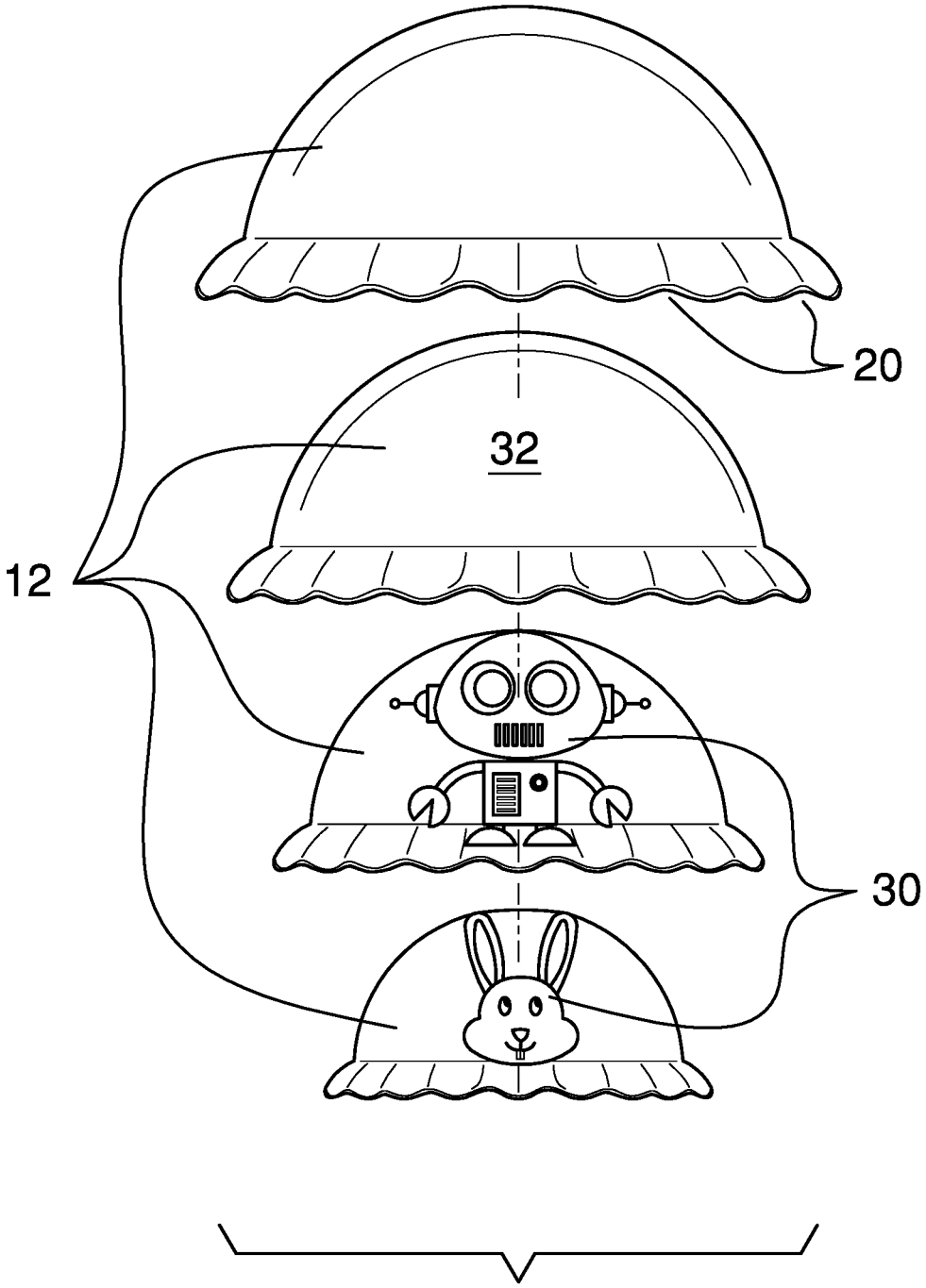
FIG. 9 is an exploded view of an embodiment of the disclosure.

With reference now to the drawings, and in particular to FIGS. 1 through 9 thereof, a new rotating device embodying the principles and concepts of an embodiment of the disclosure and generally designated by the reference numeral 10 will be described.

As best illustrated in FIGS. 1 through 9, the container lid rotating device 10 generally comprises a plurality of shells 12 that is resilient. Each shell 12 has a bottom 14 that is open and a top 16 that is domed so that the shell 12 is bowl-shaped. Each shell 12 has a respective size so that the plurality of shells 12 comprises a variety of sizes. The plurality of shells 12 is configured to be nested. Each shell 12 is configured to insert a lid of a respective container through the bottom 14 into the shell 12. The shell 12 is positioned to be grasped in a hand of a user to rotate the shell 12 and the lid relative to the respective container to selectively open and close the container.

In one embodiment, the shells 12 comprise rubber. In another embodiment, the shells 12 comprise silicone. In yet another embodiment, the plurality of shells 12 comprises from two to four shells 12. In still yet another embodiment, the plurality of shells 12 comprises three shells 12.

Each of a plurality of lips 18 is coupled to and extends radially from the bottom 14 of a respective shell 12. The lips 18 are resilient. Each lip 18 is configured to position against a side of the lid to facilitate rotation of the shell 12 and the lid relative to the respective container to selectively open and close the respective container.

In one embodiment, the lips 18 comprise rubber. In another embodiment, the lips 18 comprise silicone. In yet another embodiment, each lip 18 comprises a plurality of cutouts 20. Each cutout 20 extends from a perimeter 22 of the lip 18 toward the bottom 14. In still yet another embodiment, the cutouts 20 are arcuate.

Each of a plurality of sets of ridges 24 is coupled to and extends from an inner surface 26 of a respective shell 12. The sets of ridges 24 are resilient. Each set of ridges 24 is configured to frictionally couple to the lid to rotate the shell 12 and the lid relative to the respective container to selectively open and close the respective container.

In one embodiment, each ridge 24 of a respective set of ridges 24 extends from proximate to a center 28 of the top 16 to proximate to the bottom 14 of an associated shell 12. In another embodiment, the sets of ridges 24 comprise rubber. In yet another embodiment, the sets of ridges 24 comprise silicone.

In one embodiment, the device 10 comprises a plurality of molds 30. Each mold 30 has a respective shape so that the plurality of molds 30 comprises a variety of shapes. The variety of shapes includes animal figures, such as a pig, a bear, a lion, an elephant, a dog, a fish, and a rabbit, as well as mechanical figures, such as a robot. Each mold 30 is coupled to an exterior surface 32 of a respective shell 12. In another embodiment, the molds 30 comprise rubber. In yet another embodiment, the molds 30 comprise silicone.

In use, each shell 12 is configured to insert the lid of the respective container through the bottom 14 into the shell 12. The shell 12 is positioned to be grasped in the hand of the user. The set of ridges 24 are configured to frictionally couple to the lid. The lip 18 is configured to position against the side of the lid to facilitate rotation of the shell 12 and the lid relative to the respective container to selectively open and close the respective container.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A container lid rotating device comprising:

a plurality of shells, said shells being resilient, each said shell having a bottom and a top, said bottom being open, said top being domed such that said shell is bowl-shaped, each said shell having a respective size such that said plurality of shells comprises a variety of sizes such that said plurality of shells is configured for nesting; and wherein said bottoms are positioned in said shells such that each said shell is configured for inserting a lid of a respective container through said bottom into said shell positioning the shell for grasping in a hand of a user for rotating said shell and the lid relative to the respective container for selectively opening and closing the container.

2. The device of claim 1, further including said shells comprising rubber.

3. The device of claim 2, further including said shells comprising silicone.

4. The device of claim 1, further including said plurality of shells comprising from two to four said shells.

5. The device of claim 4, further including said plurality of shells comprising three said shells.

6. The device of claim 1, further including a plurality of lips, each said lip being coupled to and extending radially from said bottom of a respective said shell, said lips being resilient, wherein said lips are positioned on said shells such that each said lip is configured for positioning against a side of the lid for facilitating rotating said shell and the lid relative to the respective container for selectively opening and closing the respective container.

7. The device of claim 6, further including said lips comprising rubber.

8. The device of claim 7, further including said lips comprising silicone.

9. The device of claim 7, further including each said lip comprising a plurality of cutouts, each said cutout extending from a perimeter of said lip toward said bottom.

10. The device of claim 9, further including said cutouts being arcuate.

11. The device of claim 1, further including a plurality of sets of ridges, each said set of ridges being coupled to and extending from an inner surface of a respective said shell, said sets of ridges being resilient, wherein said set of ridges is positioned on said respective said shell such that said set of ridges is configured for frictionally coupling to the lid for rotating said shell and the lid relative to the respective container for selectively opening and closing the respective container.

12. The device of claim 11, further including each said ridge of a respective said set of ridges extending from proximate to a center of said top to proximate to said bottom of an associated said shell.

13. The device of claim 11, further including said sets of ridges comprising rubber.

14. The device of claim 13, further including said sets of ridges comprising silicone.

15. The device of claim 1, further including a plurality of molds, each said mold having a respective shape such that said plurality of molds comprises a variety of shapes, each said mold being coupled to an exterior surface of a respective said shell.

16. The device of claim 15, further including said molds comprising rubber.

17. The device of claim 16, further including said molds comprising silicone.

18. A container lid rotating device comprising:

a plurality of shells, said shells being resilient, each said shell having a bottom and a top, said bottom being open, said top being domed such that said shell is bowl-shaped, each said shell having a respective size such that said plurality of shells comprises a variety of sizes such that said plurality of shells is configured for nesting, wherein said bottoms are positioned in said shells such that each said shell is configured for inserting a lid of a respective container through said bottom into said shell positioning the shell for grasping in a hand of a user for rotating said shell and the lid relative to the respective container for selectively opening and closing the container, said shells comprising rubber, said shells comprising silicone, said plurality of shells comprising from two to four said shells, said plurality of shells comprising three said shells;

a plurality of lips, each said lip being coupled to and extending radially from said bottom of a respective said shell, said lips being resilient, wherein said lips are positioned on said shells such that each said lip is configured for positioning against a side of the lid for facilitating rotating said shell and the lid relative to the respective container for selectively opening and closing the respective container, said lips comprising rubber, said lips comprising silicone, each said lip comprising a plurality of cutouts, each said cutout extending from a perimeter of said lip toward said bottom, said cutouts being arcuate;

a plurality of sets of ridges, each said set of ridges being coupled to and extending from an inner surface of a respective said shell, said sets of ridges being resilient, wherein said set of ridges is positioned on said respective said shell such that said set of ridges is configured for frictionally coupling to the lid for rotating said shell and the lid relative to the respective container for selectively opening and closing the respective container, each said ridge of a respective said set of ridges extending from proximate to a center of said top to proximate to said bottom of an associated said shell, said sets of ridges comprising rubber, said sets of ridges comprising silicone;

a plurality of molds, each said mold having a respective shape such that said plurality of molds comprises a variety of shapes, each said mold being coupled to an exterior surface of a respective said shell, said molds comprising rubber, said molds comprising silicone; and wherein said bottoms are positioned in said shells such that each said shell is configured for inserting the lid of the respective container through said bottom into said shell positioning the shell for grasping in the hand of the user, wherein said set of ridges is positioned on said respective said shell such that said set of ridges is configured for frictionally coupling to the lid, wherein said lips are positioned on said shells such that each said lip is configured for positioning against the side of the lid for facilitating rotating said shell and the lid relative to the respective container for selectively opening and closing the respective container.

* * * * *